US005246568A

United States Patent [19]

Forbus et al.

[11] Patent Number: 5,246,568

[45] Date of Patent: Sep. 21, 1993

[54] CATALYTIC DEWAXING PROCESS

[75] Inventors: Thomas R. Forbus, Newtown, Pa.; Chwan P. Kyan, Mantua, N.J.

[73] Assignee: Mobil Oil Corporation, Fairfax, Va.

[21] Appl. No.: 755,372

[22] Filed: Sep. 5, 1991

Related U.S. Application Data

[63] Continuation-in-part of Ser. No. 544,088, Jun. 27, 1990, abandoned, which is a continuation of Ser. No. 359,605, Jun. 21, 1989, abandoned.

[51] Int. Cl.[5] ..... C10G 47/16

[52] U.S. Cl. ..... 208/59; 208/60; 208/48 Q; 208/152; 208/176

[58] Field of Search ..... 208/59

[56] References Cited

U.S. PATENT DOCUMENTS

| | | | |
|---|---|---|---|
| 4,372,839 | 2/1983 | Oleck et al. | 208/59 |
| 4,597,854 | 7/1986 | Penick | 208/59 |
| 4,599,162 | 7/1986 | Yen | 208/59 |
| 4,648,957 | 3/1987 | Graziani et al. | 208/59 |
| 4,695,364 | 9/1987 | Graziani et al. | 208/59 |
| 4,720,337 | 1/1988 | Graziani et al. | 208/59 |
| 4,749,467 | 6/1988 | Chen et al. | 208/59 |
| 4,877,762 | 10/1989 | Ward et al. | 208/59 |
| 4,908,593 | 3/1990 | Bowes et al. | 208/59 |
| 4,919,788 | 4/1990 | Chen et al. | 208/59 |
| 4,921,593 | 5/1990 | Smith | 208/59 |
| 4,923,591 | 5/1990 | Graziani | 208/111 |
| 4,935,120 | 6/1990 | Lipinski et al. | 208/59 |
| 4,975,177 | 12/1990 | Garwood et al. | 208/59 |
| 5,037,528 | 8/1991 | Garwood et al. | 208/59 |

*Primary Examiner*—Helane Myers

*Attorney, Agent, or Firm*—Alexander J. McKillop; Malcolm D. Keen; L. G. Wise

[57] ABSTRACT

A process for making a lubricant oil of low pour point and improved oxidation stability by catalytically hydrodewaxing a lube chargestock containing paraffin wax in a vertical column reactor having a cascade series of fixed downflow catalyst beds over dewaxing catalyst comprising acid medium pore size zeolite. The treatment is carried out by selectively hydrodewaxing paraffinic wax contained in the liquid petroleum in a first serial catalyst bed under adiabatic cracking temperature conditions while controlling adiabatic exothermal heat of reaction within a 30° C. maximum excursion from the initial reaction temperature, thereby producing lighter olefinic components, recovering partially hydrodewaxed liquid petroleum from a bottom portion of the first serial catalyst bed, and redistributing said partially hydrodewaxed liquid petroleum for contact with said catalyst in at least one downstream fixed catalyst bed.

The partially hydrocracked liquid petroleum is further reacted to effect endothermic hydrodewaxing concurrently with exothermic hydrogen transfer, dewaxing, hydrogenation and cyclization in the presence of hydrogen under adiabatic temperature conditions, permitting net exothermic reaction temperature to rise not more than 30° C. in said downstream catalyst bed.

Temperature control is maintained by injecting hydrogen quench fluid into at least one downstream catalyst bed concurrently with partially hydrodewaxed liquid petroleum to decrease reaction temperature, thereby maintaining a maximum temperature excursion of about 30° C. throughout said series of fixed catalyst beds and controlling uniform hydro-dewaxing conditions to obtain high quality petroleum lubricant product.

15 Claims, 2 Drawing Sheets

CATALYTIC DEWAXING PROCESS

CROSS-REFERENCE TO RELATED APPLICATIONS

This application is a continuation-in-part of co-pending U.S. Pat. application Ser. No. 07/544,088, filed Jun. 27, 1990, now abandoned which is a continuation of U.S. Ser. No. 07/359,605, filed Jun. 1, 1989, now abandoned by T. R. Forbus and C. P. Kyan.

BACKGROUND OF THE INVENTION

This invention relates to catalytic dewaxing of petroleum chargestocks wherein a liquid phase reactant is contacted with a gaseous phase reactant. In particular, it relates to an improvement in reactor configuration and operations for contacting multi-phase reactants in a fixed porous catalyst bed under continuous operating conditions, including techniques for controlling reaction temperature in the reactor.

Mineral oil lubricants are derived from various crude oil stocks by a variety of refining processes directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in the lubestocks from such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as furfural, N-methyl-2-pyrrolidone, phenol or another material which is selective for the extraction of the aromatic components. If the lube stock is a residual lube stock, the asphaltenes will first be removed in a propane deasphalting step followed by solvent extraction of residual aromatics to produce a lube generally referred to as bright stock. In either case, however, a dewaxing step is normally necessary in order for the lubricant to have a satisfactorily low pour point and cloud point, so that it will not solidify or precipitate the less soluble paraffinic components under the influence of low temperatures.

A number of dewaxing processes are known in the petroleum refining industry and of these, solvent dewaxing with solvents such as methyl ethyl ketone (MEK), a mixture of MEK and toluene or liquid propane, has been the one which has achieved the widest use in the industry. Recently, however, catalytic dewaxing processes have entered use for the production of lubricating oil stocks and these processes possess a number of advantages over the conventional solvent dewaxing procedures. These catalytic dewaxing processes are generally similar to those which have been proposed for dewaxing the middle distillate fractions such as heating oils, jet fuels and kerosenes, of which a number have been disclosed in the literature, for example, in *Oil and Gas Journal*, Jan. 6, 1975, pp. 69–73 and U.S. Pat. Nos. RE 28,398, 3,956,102 and 4,100,056. Generally, these processes operate by selectively cracking the normal and slightly branched paraffins to produce lower molecular weight products which may then be removed by distillation from the higher boiling lube stock. A subsequent hydrotreating step may be used to stabilize the product by saturating lube boiling range olefins produced by the selective cracking which takes place during the dewaxing. Reference is made to U.S. Pat. Nos. 3,894,938 and 4,181,598 for descriptions of such processes.

A dewaxing process employing synthetic offretite is described in U.S. Pat. No. 4,259,174. Processes of this type have become commercially available as shown by the 1986 Refining Process Handbook, page 90, Hydrocarbon Processing, September 1986, which refers to the availability of the Mobil Lube Dewaxing Process (MLDW). The MLDW process is also described in Chen et. al. "Industrial Application of Shape-Selective Catalysis" Catal. *Rev.-Sci. Eng.* 28, (283), 185–264 (1986), especially pp. 241–247, to which reference is made for a further description of the process. Reference is made to these disclosures for a description of various catalytic dewaxing processes.

In the catalytic dewaxing processes of this kind, the catalyst becomes progressively deactivated as the dewaxing cycle progresses and to compensate for this, the temperature of the dewaxing reactor is progressively raised in order to meet the target pour point for the product. There is a limit, however, to which the temperature can be raised before the properties of the product, especially oxidation stability become unacceptable. For this reason, the catalytic dewaxing process is usually operated in cycles with the temperature being raised in the course of the cycle from a low start-of-cycle (SOC) value, typically about 500° F. (about 260° C.), to a final, end-of cycle (EOC) value, typically about 680° F. (about 360° C.), after which the catalyst is reactivated or regenerated for a new cycle. Typically, the catalyst may be reactivated by hydrogen stripping several times before an oxidative regeneration is necessary as described in U.S. Pat. Nos. 3,956,102; 4,247,388 and 4,508,836 to which reference is made for descriptions of such hydrogen reactivation procedures. Oxidative regeneration is described, for example, in U.S. Pat. Nos. 4,247,388; 3,069,363; 3,956,102 and G.B. U.S. Patent No. 1,148,545. It is believed that the hydrogen reactivation procedure occurs by transfer of hydrogen to the coke on the deactivated catalyst to form more volatile species which are then stripped off at the temperatures used in the process.

The use of a metal hydrogenation component on the dewaxing catalyst has been described as a highly desirable expedient, both for obtaining extended dewaxing cycle durations and for improving the reactivation procedure even though the dewaxing reaction itself is not one which required hydrogen for stoichiometric balance. U.S. Pat. No. 4,683,052 discloses the use of noble metal components e.g. Pt, Pd as superior to base metals such as nickel for this purpose. During the dewaxing cycle itself, nickel on the catalyst was thought to reduce the extent of coke lay-down by promoting transfer of hydrogen to coke precursors deposited on the catalyst during the dewaxing reactions. Similarly, the metal was also thought to promote removal of coke and coke precursors during hydrogen reactivation by promoting hydrogen transfer to these species to form materials which would be more readily desorbed from the catalyst. Thus, the presence of a metal component was considered necessary for extended cycle life, especially after hydrogen reactivation.

Chemical reactions between liquid and gaseous reactants present difficulties in obtaining intimate contact between phases. Such reactions are further complicated when the desired reaction is catalytic and requires contact of both fluid phases with a solid catalyst. In the operation of conventional concurrent multiphase reactors, the gas and liquid under certain circumstances tend to travel different flow paths. The gas phase can flow in the direction of least pressure resistance; whereas the liquid phase flows by gravity in a trickle path over and around the catalyst particles. Under conditions of low liquid to gas ratios, parallel channel flow and gas frictional drag can make the liquid flow non-uniformly, thus leaving portions of the catalyst bed underutilized due to lack of adequate wetting. Under these circumstances, commercial reactor performance can be much poorer than expected from laboratory studies in which flow conditions in small pilot units can be more uniform.

The segregation of the liquid and gaseous phases in a non-uniform manner in a commercial reactor is sometimes referred to as maldistribution. Attempts have been made to avoid maldistribution, such as the provision of multiple layers of catalyst with interlayered redistributors located along the reactor longitudinal axis. Numerous multi-phase reactor systems have been developed wherein a fixed porous bed of solid catalyst is retained in a reactor. Typically, fixed bed reactors have been arranged with the diverse phases being passed cocurrently over the catalyst, for instance as shown in U.S. Pat. No. 4,126,539 (Derr et. al.), 4,235,847 (Scott), 4,283,271 (Garwood et. al.), and 4,396,538 (Chen et. al.). While prior reactor systems are satisfactory for certain needs, efficient multi-phase contact has been difficult to achieve for some fixed bed applications when maldistribution occurs as the reactants progress through the catalyst bed, particularly in those instances when the liquid phase is small compared to the gaseous phase. This phenomena of maldistribution developing as reactants pass through the catalyst bed can occur in commercial size large diameter reactors but is not seen in small diameter laboratory units.

In the petroleum refining industry, multi-phase catalytic reactor systems have been employed for dewaxing, hydrogenation, desulfurizing, hydrocracking, isomerization and other treatments of liquid feedstocks, especially heavy distillates, lubricants, heavy oil fractions, residuum, etc. In the following description, emphasis is placed on a selective hydrodewaxing process, which employs a catalyst comprising a medium pore siliceous zeolite having a constraint index of about 2 to 12, for example, an acidic ZSM-5 type pentasil aluminosilicate having a silica to alumina mole ratio greater than 12.

In the refining of lubricants derived from petroleum by fractionation of crude oil, a series of catalytic reactions are employed for severely hydrotreating, converting and removing sulfur and nitrogen contaminants, hydrocracking and isomerizing components of the lubricant charge stock in one or more catalytic reactors. This can be followed by hydrodewaxing and/or hydrogenation (mild hydrotreating) in contact with different catalysts under varying reaction conditions. An integrated three-step lube refining process disclosed by Garwood et. al., in U.S. Pat. No. 4,283,271 is adaptable according to the present invention.

In a typical multi-phase reactor system, the average gas-liquid volume ratio in the catalyst zone is about 1:4 to 20:1 under process conditions. Preferably the liquid is supplied to the catalyst bed at a rate to occupy about 10 to 50% of the void volume. The volume of gas may decrease due to reactant depletion, as the liquid feedstock and gas pass through the reactor. Vapor production, adiabatic heating or expansion can also affect the volume.

SUMMARY OF THE INVENTION

An improved hydrodewaxing process has been discovered for treating high-boiling, paraffinic wax-containing liquid petroleum chargestock. Such chargestocks typically contain less than 60 wt % aromatics, and may comprise distillate or bright stock. The process sequence includes a) uniformly distributing and contacting the liquid chargestock in the presence of cofed hydrogen at a pressure of at least 7000 kPa with an acid, shape-selective, medium pore metallosilicate hydrodewaxing catalyst, said catalyst being substantially free of hydrogenation-dehydrogenation components in a reactor having a series of fixed downflow catalyst beds; (b) selectively hydrodewaxing paraffinic wax contained in the liquid petroleum in a first serial catalyst bed under adiabatic cracking temperature conditions to partially reduce wax content and thereby producing lighter olefinic components; (c) recovering partially dewaxed liquid petroleum and hydrogen-rich gas from a bottom portion of the first serial catalyst bed and redistributing said partially hydrodewaxed liquid petroleum and hydrogen-rich gas for contact with said catalyst in at least one downstream fixed catalyst bed; (d) further reacting said partially hydrocracked liquid petroleum and olefinic component to effect additional endothermic dewaxing, and exothermic hydrogen transfer, olefin oligomerization, hydrogenation and cyclization in the presence of hydrogen under adiabatic temperature conditions, permitting reaction temperature to rise not more than 30° C. in said downstream catalyst bed; and e) injecting hydrogen-rich quench gas at the inlet of at least one downstream catalyst bed concurrently with partially hydrodewaxed liquid petroleum to decrease reaction temperature, thereby maintaining a maximum temperature excursion of about 30° C. throughout said series of fixed catalyst beds and controlling uniform hydro-dewaxing conditions to obtain high quality petroleum lubricant product.

In the preferred embodiments, the reactor comprises a vertical column containing at least three separate catalyst beds with uniform liquid distribution above each bed, and wherein cold hydrogen quench gas is injected into effluent from an exothermic middle bed. The process is particularly useful where the liquid petroleum chargestock is high pressure hydrocracked gas oil containing about 1 to 40 wt % mononuclear aromatic hydrocarbons and boiling above about 315° C. The catalyst may comprise aluminosilicate zeolite having a constraint index of about 2 to 12 and an acid cracking alpha value less than 150 without nickel, noble metal or other hydrogenation components. The preferred catalyst consists essentially of aluminosilicate zeolite having the structure of ZSM-5 and an alpha value of about 45 to 95.

In preferred embodiments, hydrogen partial pressure in the first serial catalyst bed is maintained in the range of about 7000 to 20,000 kPa (preferably about 18,000 kPa), and hydrodewaxing is conducted without substantial net consumption of hydrogen at initial reaction temperature of about 200° C. to 315° C. These and other features and advantages of the invention will be seen in the following description and drawing.

DESCRIPTION OF PREFERRED EMBODIMENTS

Figure 1:
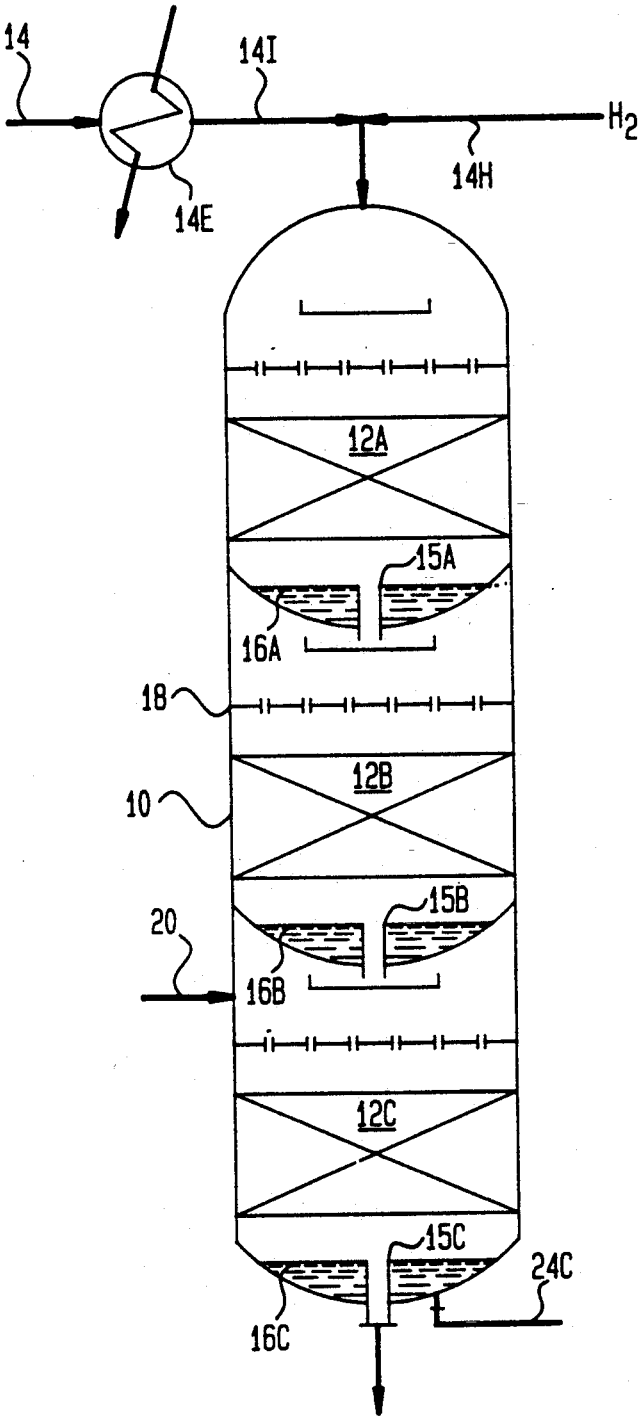
FIG. 1 is a simplified diagram showing a vertical reactor with fixed catalyst beds, showing major flow streams and distribution equipment.

Primary emphasis is placed on a reactor column design vertically spaced beds; however, one skilled in the art will understand that separate vessels can be employed for successive catalyst bed portions, if desired. The reactor system is depicted schematically in FIG. 1, with the main fluid conduits shown in solid line and control interface signal means in dashed line. A vertical reactor shell 10 is fabricated to enclose and support a stacked series of fixed porous solid catalyst beds 12A,-B, C. A petroleum chargestock comprising wax-containing liquid oil is introduced via conduit 14, heater 14E, and upper inlet means 14I concurrently with hydrogen-rich gas stream 14H.

Partially converted liquid and gas flow downwardly from the initial catalyst contact zone 12A through conduit 15A into the next catalyst zone. Conduit 15A is positioned so liquid collects in an internal head 16A and overflows into conduit 15A. After passing through first bed 12A, the liquid phase is collected and redistributed via tray or plate 18. Uniform distribution of liquid and vapor to the catalyst bed is obtained by a suitable distributor tray system well known in the art. Alternatively distributor means 18 can be operatively connected to an internal liquid spray header distributor as a means for distributing recycle liquid over he catalyst bed (see Graven and Zahner U.S. Pat. No. 4,681,674, incorporated by reference). Typically, the liquid and gas phases are introduced into the reactor at a desired pressure and temperature; however, it is feasible to adjust the liquid temperature by heat exchange in an external flow loop, thereby allowing independent control of the temperature in any catalyst bed if this should be desirable.

Partially converted liquid and vapor are distributed to catalyst bed 12B so a substantially uniform liquid flux to the catalyst bed can be achieved under varying feed rates.

The operation of the succeeding stages is similar to that described in the initial conversion stage, with corresponding numbered elements being designated by letters A, B, C, according to the association with beds 12A, 12B, 12C. Interbed quench stream 20, introduces cooler hydrogen to control adiabatic temperature rise.

Liquid distribution is achieved by any conventional technique, such as distributor trays or spray headers, which projects the liquid onto the lower bed surface 12B,C at spaced points. A layer of porous balls, screen or perforated plate may be employed to facilitate uniform distribution. The liquid phase again contacts hydrogen reactant gas, which passed through the baffle means via vapor hats in a known manner.

Treated liquid from the final bed 12C may be recovered via conduit 24C.

A continuous three-stage reactor system has been described for contacting gas and liquid phases with a series of porous catalyst beds; however, it may be desired to have two, four or more beds operatively connected for successive treatment of the reactants. The catalyst composition may be the same in all beds; however, it is within the inventive concept to have different catalysts and reaction conditions in the separated beds. A typical vertical reactor vessel has top inlet means for feeding gas and liquid reactant streams and bottom product recovery means. The vessel will have at least two vertically-spaced porous catalyst beds supported in the reactor shell for contacting gas and liquid reactants in concurrent flow and top distributor means for applying liquid and gas and uniformly over the top bed cross section. In the preferred embodiments, at least one interbed redistributor means will comprise a gravity flow liquid collection reservoir and distributor plate having gas-liquid downcomer means passing therethrough. Design and operation can be adapted to particular processing needs according to sound chemical engineering practices.

The present technique is adaptable to a variety of catalytic dewaxing operations, particularly for treatment of lubricant-range heavy oils with hydrogen-containing gas at elevated temperature. Industrial processes employing hydrogen, especially petroleum refining, employ recycled impure gas containing 10 to 50 mole % or more of impurities, usually light hydrocarbons and nitrogen. Such reactant gases are available and useful herein, especially for high temperature hydrodewaxing at elevated pressure.

Advantageously, the catalyst bed has a void volume fraction greater than 0.25. Void fractions from 0.3 to 0.5 can be achieved using loosely packed polylobal or cylindrical extrudates, providing adequate liquid flow rate component for uniformly wetting catalyst to enhance mass transfer and catalytic phenomena.

In the present process, a lube feedstock, typically a 650° F.+ (about 345° C.+) feedstock is subjected to catalytic dewaxing over an intermediate pore size dewaxing catalyst in the presence of hydrogen to produce a dewaxed lube boiling range product of low pour point (ASTM D-97 or equivalent method such as Autopour). For typical waxy feedstock the hydrogen feedrate at the top of the reactor is about 150–650 SCF/BBL. In order to improve the stability of the dewaxed lube boiling range materials in the dewaxed effluent, a hydrotreating step is generally carried out. Products produced during the dewaxing step which boil outside the lube boiling range can be separated by fractional distillation.

Feedstock

The hydrocarbon feedstock is a lube range feed with an initial boiling point and final boiling point selected to produce a lube stock of suitable lubricating characteristics. The feed is conventionally produced by the vacuum distillation of a fraction from a crude source of suitable type. Generally, the crude will be subjected to an atmospheric distillation and the atmospheric residuum (long resid) will be subjected to vacuum distillation to produce the initial lube stocks. The vacuum distillate stocks or "neutral" stocks used to produce relatively low viscosity paraffinic products typically range from 150 SUS (10 cSt) at 40° C. for a light neutral to about 750 SUS (160 cSt) at 40° C. for a heavy neutral. The distillate fractions are usually subjected to solvent extraction to improve their V.I. and other qualities by selective removal of the aromatics using a solvent which is selective for aromatics such as furfural, phenol, or N-methyl-pyrrolidone. The vacuum resid may be used as a source of more viscous lubes after deasphalting, usually by propane deasphalting (PDA) followed by solvent extraction to remove undesirable, high viscosity, low V.I. aromatic components. The raffinate is generally referred to as Bright Stock and typically has a viscosity of 100 to 300 SUS at 100° C. (21 to 61 cSt).

Lube range feeds may also be obtained by other procedures whose general objective is to produce an oil of suitable lubricating character from other sources, including marginal quality crudes, shale oil, tar sands and/or synthetic stocks from processes such as methanol or olefin conversion or Fischer-Tropsch synthesis. The lube hydrocracking process is especially adapted to use in a refinery for producing lubricants from asphaltic or other marginal crude sources because it employs conventional refinery equipment to convert the relatively aromatic (asphaltic) crude to a relatively paraffinic lube range product by hydrocracking. Integrated all-catalytic lubricant production processes employing hydrocracking and catalytic dewaxing are described in U.S. Patents Nos. 4,414,097, 4,283,271, 4,283,272, 4,383,913, 4,347,121, 3,684,695 and 3,755,145. Processes for converting low molecular weight hydrocarbons and other starting materials to lubestocks are described, for example, in U.S. Pat. Nos. 4,547,612, 4,547,613, 4,547,609, 4,517,399 and 4,520,221, to which reference is made for a description of these processes.

The lube stocks used for making turbine oil products are the neutral or distillate stocks produced from selected crude sources during the vacuum distillation of a crude source, preferably of a paraffinic nature such as Arab Light crude. Turbine oils are required to possess exceptional oxidative and thermal stability and generally this implies a relatively paraffinic character with substantial freedom from excessive quantities of undesirable aromatic compounds, although some aromatic content is desirable for ensuring adequate solubility of lube additives such as anti-oxidants, and anti-wear agents. The paraffinic nature of these turbine oil stocks will, however, often imply a high pour point which needs to be reduced by removing the waxier paraffins, principally the straight chain n-paraffins, the monomethyl paraffins and the other paraffins with relatively little chain branching.

General Process Considerations

Prior to catalytic dewaxing, the feed may be subjected to conventional processing steps such as solvent extraction to remove, if necessary, aromatics or to hydrotreating under conventional conditions to remove heteroatoms and possibly to effect some aromatics saturation or to solvent dewaxing to effect an initial removal of waxy components.

In general terms, these catalytic dewaxing processes are operated under conditions of elevated temperature, usually ranging from about 400° to 800° F. (about 205° to 425° C.), but more commonly from 500° to 700° F. (about 260° to 370° C.), depending on the dewaxing severity necessary to achieve the target pour point for the product.

As the target pour point for the product decreases the severity of the dewaxing process will be increased so as to effect an increasingly greater removal of paraffins with increasingly greater degrees of chain branching, so that lube yield will generally decrease with decreasing product pour point as successively greater amounts of the feed are converted by the selective cracking of the catalytic dewaxing to higher products boiling outside the lube boiling range. The V.I. of the product will also decrease at lower pour points as the high V.I. iso-paraffins of relatively low degree of chain branching are progressively removed.

In addition, the temperature is increased during each dewaxing cycle to compensate for decreasing catalyst activity, as described above. The dewaxing cycle will normally be terminated when a temperature of about 675° F. (about 357° C.) is reached since product stability is too low at higher temperatures. The improvement in the oxidation stability of the product is especially notable at temperatures above about 630° F. (about 330° C.) or 640° F. (about 338° C.) with advantages over the nickel-containing catalysts being obtained, as noted above, at temperatures above about 620° F. (about 325° C.).

Hydrogen is not required stoichiometrically but promotes extended catalyst life by a reduction in the rate of coke laydown on the catalyst. ("Coke" is a highly carbonaceous hydrocarbon which tends to accumulate on the catalyst during the dewaxing process.) The process is therefore carried out in the presence of hydrogen, typically at 400–800 psig (about 2860 to 562 kPa, abs.) although higher pressures can be employed. Hydrogen circulation rate is typically 1000 to 4000 SCF/bbl, usually 2000 to 3000 SCF/bbl of liquid feed (about 180 to 710, usually about 355 to 535 n.l.l.$^{-1}$). Space velocity will vary according to the chargestock and the severity needed to achieve the target pour point but is typically in the range of 0.25 to 5 LHSV (hr$^{-1}$), usually 0.5 to 2 LHSV.

In order to improve the quality of the dewaxed lube products, a hydrotreating step follows the catalytic dewaxing in order to saturate lube range olefins as well as to remove heteroatoms, color bodies and, if the hydrotreating pressure is high enough, to effect saturation of residual aromatics. The post-dewaxing hydrotreating is usually carried out in cascade with the dewaxing step so that the relatively low hydrogen pressure of the dewaxing step will prevail during the hydrotreating and this will generally preclude a significant degree of aromatics saturation. Generally, the hydrotreating will be carried out at temperatures from about 400° F. to 600° F. (about 205° to 315° C.), usually with higher temperatures for residual fractions (bright stock), (for example, about 500° to 575° F. (about 260° to 300° C.) for bright stock and, for example, about 425° to 500° F. (about 220° to 260° C.) for the neutral stocks. System pressures will correspond to overall pressures typically from 400 to 1000 psig (2860 to 7000) kPa, abs.) although lower and higher values may be employed e.g. 2000 or 3000 psig (about 13890 kPa or 20785 abs.). Space velocity in the hydrotreater is typically from 0.1 to 5 LHSV (hr$^{-1}$), and in most cases from 0.5 to 2 hr$^{-1}$.

Processes employing sequential lube catalytic dewaxing-hydrotreating are described in U.S. Pat. Nos. 4,181,598, 4,137,148 and 3,894,938. A process employing a reactor with alternating dewaxing-hydrotreating beds in disclosed in U.S. Pat. No. 4,597,854. Reference is made to these patents for details of such processes.

Description of Catalysts

Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, B, or Fe, within the zeolitic framework. Medium pore aluminosilicate zeolites are favored for shape selective acid catalysis; however, the advantages of ZSM-5 structures may be utilized by employing highly siliceous materials or crystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et. al.), incorporated by reference.

The catalysts which have been proposed for shape selective catalytic dewaxing processes have usually been zeolites which have a pore size which admits the straight chain, waxy n-paraffins either alone or with only slightly branched chain paraffins but which exclude more highly branched materials and cycloaliphatics. Intermediate pore size zeolites such as ZSM-5 and the synthetic ferrierites have been proposed for this purpose in dewaxing processes, as described in U.S. Pat. Nos. 3,700,585 (Re 28398); 3,894,938; 3,933,974; 4,176,050; 4,181,598; 4,222,855; 4,259,170; 4,229,282; 4,251,499; 4,343,692, and 4,247,388. The hydrodewaxing catalysts preferred for use herein include the medium pore (i.e., about 5–7A) shape selective crystalline aluminosilicate zeolites having a silica-to-alumina ratio of at least 12, a constraint index of about 2 to 12 and significant Bronsted acid activity. The fresh or reactivated catalyst preferably has an acid activity (alpha value) of about 45 to 75. Representative of the ZSM-5 type zeolites are ZSM-5 (US 3,702,886), ZSM-11 (U.S. Pat. No. 3,709,979), ZSM-22, ZSM-23 (U.S. Pat. No. 4,076,842), ZSM-35 (U.S. Pat. No. 4,016,245), ZSM-48 (U.S. Pat. No. 4,375,573), ZSM-57, and MCM-22 (U.S. Pat. No. 4,954,325). The disclosures of these patents are incorporated herein by reference. While suitable zeolites having a coordinated metal oxide to silica molar ratio of 20:1 to 200:1 or higher may be used, it is advantageous to employ a standard aluminosilicate ZSM-5 having a silica:alumina molar ratio of about 25:1 to 70:1, suitably modified to obtain an acid cracking activity (alpha value) less than 150. A typical zeolite catalyst component having Bronsted acid sites may consist essentially of crystalline aluminosilicate having the structure of ZSM-5 zeolite with 5 to 95 wt. % silica, clay and/or alumina binder. It is understood that other medium pore acidic metallosilicates, such as silicalite, silica- aluminophosphates (SAPO) materials may be employed as catalysts.

These siliceous materials may be employed in their acid forms, substantially free of hydrogenation-dehydrogenaton components, such as the noble metals of Group VIIIA, especially platinum, palladium, rhenium or rhodium. Base metal hydrogenation components, especially nickel, cobalt, molybdenum, tungsten, copper or zinc may also be deleterious to the selective hydrodewaxing reaction.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02–1 micron being preferred. Fixed bed catalyst may consist of a standard 70:1 aluminosilicate H-ZSM-5 extrudate having an acid value less than 150, preferably about 45–95.

When Alpha Value is examined, it is noted that the Alpha Value is an approximate indication of the catalytic cracking activity of the catalyst compared to a standard catalyst and it gives the relative rate constant (rate of normal hexane conversion per volume of catalyst per unit time). It is based on the activity of the highly active silica-alumina cracking catalyst taken as an Alpha of 1 in U.S. Pat. No. 3,354,078, in the *Journal of Catalysis,* Vol. 4, p. 527 (1965); Vol. 6, p. 278 (1966); and Vol. 61, p. 395 (1980), each incorporated herein by reference as to that description. The experimental conditions of the text used herein include a constant temperature of 538° C. and a variable flow rate as described in detail in the *Journal of Catalysis,* Vol. 61, p. 394.

Catalyst size can vary widely within the inventive concept, depending upon process conditions and reactor structure. If a low space velocity or long residence in the catalytic reaction zone is permissible, catalysts having an average maximum dimension of 1 to 5 mm may be employed.

Reactor configuration is an important consideration in the design of a continuously operating system. In its simplest form, a vertical pressure vessel is provided with a series of stacked catalyst beds of uniform cross-section. A typical vertical reactor having a total catalyst bed length to average width (L/D aspect) ratio of about 1:1 to 20:1 is preferred. Stacked series of beds may be retained within the same reactor shell; however, similar results can be achieved using separate side-by-side reactor vessels, with pumps moving liquid from lower levels to higher inlet points above succeeding downstream beds. Reactors of uniform horizontal cross section are preferred; however, non-uniform configurations may also be employed, with appropriate adjustments in the bed flux rate and corresponding recycle rates.

The invention is particularly useful in catalytic hydrodewaxing of heavy petroleum gas oil lubricant feedstock boiling above 315° C. (600° F.). The catalytic treatment may be performed at an hourly liquid space velocity not greater than 2 $hr^{-1}$, preferably about 1 $hr^{-1}$, over randomly packed beds of 1.5 mm extrudate catalyst of the ZSM-5 type zeolite catalyst having a porosity (apparent void volume fraction) of 0.35 to 0.4 usually at a catalyst loading of about 40 pounds/$ft^3$. The hydrocarbon oil has a viscosity of 0.1 to 1 centipoise. Advantageously, the liquid flux rate for total feed rate (including optional liquid recycle) is maintained at about 2000 pounds/$ft^2$-hr, with a total column in height of 50 feet. The reactant gas is fed at a uniform volumetric rate per barrel of oil.

Catalyst aging characteristics may be materially improved by the use of metal-free catalysts: a trend towards line-out behavior is noted, with aging rates decreasing to values below about 1° F./day (about 0.5° C./day) in the latter portions of the dewaxing cycle, for example, at temperatures above about 650° F. (about 345° C.). Cumulative aging rates below about 5° F./day (about 2.8° C./day), usually below about 4° F./day (about 2° C./day) may be obtained over the course of the cycle. The improved amenability of the catalyst to reactivation by hydrogen stripping is also unexpected since the metal function was thought to be essential to satisfactory removal of the coke during this step. Contrary to this expectation, it has been found not only that the reactivated catalyst gives adequate performance over the second and subsequent cycles but that cycle lengths may even be extended with comparable catalyst activities at the beginning of each cycle so that equivalent start-of-cycle (SOC) temperatures may be employed.

It is believed that the improvements in aging rate and susceptibility to hydrogen reactivation which are associated with the use of the metal-free dewaxing catalysts may be attributable to the character of the coke formed during the dewaxing. It is possible that at the higher temperatures prevailing at the end of the dewaxing cycle, the nickel or other metal component promotes dehydrogenation of the coke and converts to a harder or more highly carbonaceous form; in this form not only is the catalyst aging increased but the hard coke so formed is less amendable to hydrogenative stripping between cycles. Thus, the absence of the metal component may be directly associated with the end-of-cycle aging improvements and the improved reactivation characteristics of the catalyst.

The hydrogen or decationised or "acid" form of the zeolite is readily formed in the conventional way by cation exchange with an ammonium salt followed by calcination to decompose the ammonium cations, typically at temperatures above about 800° F. (about 425° C.), usually about 1000° F. (about 540° C.). Dewaxing catalysts containing the acid form zeolite are conveniently produced by compositing the zeolite with the binder and forming the catalyst particles followed by ammonium exchange and calcination. If the zeolite has been produced using an organic directing agent, calcination prior to the cation exchange step is necessary to remove the organic from the pore structure of the zeolite; this calcination may be carried out either in the zeolite itself or the matrixed zeolite.

Hydrotreating

The employment of a hydrotreating step following the dewaxing offers further opportunity to improve product quality without significantly affecting its pour point. The metal function on the hydrotreating catalyst is effective in varying the degree of desulfurization in the same way as the metal function on the dewaxing catalyst. Thus, a hydrotreating catalyst with a strong desulfurization/ hydrogenation function such as nickel-molybdenum or cobalt-molybdenum will remove more of the sulfur than a weaker desulfurization function such as molybdenum. Thus, because the retention of certain desired sulfur compounds is related to superior oxidative stability, the preferred hydrotreating catalysts will comprise a relatively weak hydrodesulfurization function on a porous support. Because the desired hydrogenation reactions require no acidic functionality and because no conversion to lower boiling products is desired in this step, the support of the hydrotreating catalyst is essentially non-acidic in character. Typical support materials include amorphous or crystalline oxide materials such as alumina, silica, and silica-alumina of non-acidic character. The metal content of the catalyst is typically up to about 20 weight percent for base metals with lower proportions being appropriate for the more active noble metals such as palladium. Hydrotreating catalysts of this type are readily available from catalyst suppliers. These catalysts are generally presulfided using $H_2S$ or other suitable sulfur containing compounds. The degree of desulfurization activity of the catalyst may be found by experimental means, using a feed of known composition under fixed hydrotreating conditions. Control of the reaction parameters of the hydrotreating step also offers a useful way of varying the product properties. As hydrotreating temperature increases the degree of desulfurization increases; although hydrogenation is an exothermic reaction favored by lower temperatures, desulfurization usually requires some ring-opening of heterocyclic compounds to occur and these reactions, are favored by higher temperatures. If, therefore, the temperature during the hydrotreating step can be maintained at a value below the threshold at which excessive desulfurization takes place, products of improved oxidation stability are obtained. Using a metal such as molybdenum on hydrotreating catalyst temperatures of about 400°-700° F. (about 205°-370° C.), preferably about 500°-650° F. (about 260°-15° C.) are recommended for good oxidative stability. Space velocity in the hydrotreater also offers a potential for desulfurization control with the higher velocities corresponding to lower severities being appropriate for reducing the degree of desulfurization. The hydrotreated product preferably has an organic sulfur content of at least 0.10 wt. percent or higher e.g. at least 0.20 wt. percent, e.g. 0.15–0.20 wt. percent.

Variation of the hydrogen pressure during the hydrotreating step also enables the desulfurization to be controlled with lower pressures generally leading to less desulfurization as well as a lower tendency to saturate aromatics, and eliminate peroxide compounds and nitrogen, all of which are desirable. A balance may therefore need to be achieved between a reduced degree of desulfurization and a loss in the other desirable effects of the hydrotreating. Generally, pressures of 200 to 1000 psig (about 1480 to 7000 kPa abs) are satisfactory with pressures of 400 to 800 psig (about 2860 to 5620 kPa abs) giving good results with appropriate selection of metal function and other reaction conditions made empirically by determination of the desulfurization taking place with a given feed.

Sequencing

The preferred manner of sequencing different lube feeds through the dewaxer is first to process heavy feeds such as Heavy Neutral and Bright Stock, followed by lighter feeds such as Light Neutral in order to avoid contacting the light stocks with the catalyst in its most active conditions. In practice we prefer a Heavy Neutral/Bright Stock/Light Neutral sequence in the course of a dewaxing cycle.

Products

The lube products obtained with the present process have a higher retained sulfur content than corresponding lubes dewaxed over a metal-containing dewaxing catalyst e.g. NiZSM-5. The retained aliphatic sulfur content, in particular, is higher and it is believed that the noted improvements in product stability may be attributable in part to the retention of these compounds. In general terms, the sulfur content of the products will increase with product initial boiling point an viscosity and is typically as follows:

TABLE 1

| Typical Minimum Lube Sulfur Content, wt. pct. | |
|---|---|
| Lube | $S_{Total}$ $S_{Aliph}$ |
| Light Neutral (100–200 SUS at 40° C.) | 0.2–0.6 |

TABLE 1-continued

| Typical Minimum Lube Sulfur Content, wt. pct. | | |
|---|---|---|
| Lube | $S_{Total}$ | $S_{Aliph}$ |
| 0.15–0.25 | | |
| Heavy Neutral (600–800 SUS at 40° C.) | 0.9–1.25 | |
| 0.3–0.4 | | |
| Bright Stock (100–300 SUS at 100° C.) | 1.00–1.5 | |
| 0.35–0.5 | | |

The notable feature of the present process is that the sulfur content of the dewaxed lube product remains sensibly constant over the duration of the dewaxing cycle as the temperature of the dewaxing step is increased to compensate for the progressive decrease in the dewaxing activity of the catalyst. This behavior is in marked contrast to the behavior observed with the metal-functionalized dewaxing catalysts such as NiZSM-5 where the aliphatic sulfur content decreases in a marked fashion as the temperature increases in the cycle. In fact, increases in aliphatic sulfur may be observed.

Catalyst Reactivation

As noted above, the dewaxing catalysts are preferably reactivated by treatment with hot hydrogen to restore activity by removing soft coke and coke precursors in the form of more volatile compounds which are desorbed from the catalyst under the conditions employed. Suitable reactivation procedures are disclosed in U.S. Pat. Nos. 3,956,102, 4,247,388 and 4,508,836. A notable and perhaps significant feature of the present metal-free catalysts is that the total amount of ammonia released during the hydrogen reactivation is significantly less than that from metal-containing dewaxing catalysts such as NiZSM-5. This may indicate that fewer heterocyclic compounds are sorbed as coke precursors by the metal-free catalysts, consistent with the observation that a greater degree of sulfur retention also occurs.

Example 1

A light neutral (150 SUS at 40° C.) waxy raffinate was catalytically dewaxed over an HZSM-5 alumina dewaxing catalyst (65 wt. pct. HZSM-5, 35 wt. pct. alumina) at temperatures between 590° F. and 676° F. (310° C. and 350° C.), 2 $hr^{-1}$ LHSV, 400 psig (2860 kPa abs.) 2500 SCF/bbl $H_2$ circulation rate (445 n.l.l.$^{-1}$) to provide a turbine oil base stock. A number of the dewaxed products were then hydrotreated using a molybdenum/alumina hydrotreating catalyst at the same hydrogen pressure and circulation rate. The products were topped to produce a 650° F.+(345° C.+) lube product to which a standard mixed double inhibited antioxidant/antirust inhibitor package containing a hindered phenol antioxidant was added. The oxidation stability was then determined by the Rotating Bomb Oxidation Test, ASTM D-2272 and the Turbine Oil Oxidation Stability Test D-943. The results are shown in Table 2 below.

TABLE 2

| Turbine Oil Dewaxing over HZSM-5 | | | | | | |
|---|---|---|---|---|---|---|
| Run No. | HDW/HDF °F. | Pour Pt, °F. (°C.) | RBOT, Mins. | TOST, hrs. | Sulfur wt pct | Aliphatic Sulfur, wt pct |
| 1-1 | 590/— | 35 (2) | 460 | 5650 | 0.36 | 0.15 |
| 1-2 | 608/— | 25 (−4) | 440 | 6050 | 0.36 | 0.16 |
| 1-3 | 630/— | 15 (−9) | 390 | 5894 | 0.38 | 0.16 |
| 1-4 | 640/— | 10 (−12) | 385 | 5201 | 0.37 | 0.17 |
| 1-5 | 651/— | 5 (−15) | 435 | 5762 | 0.37 | 0.17 |
| 1-6 | 658/— | 5 (−15) | 385 | 5896 | 0.37 | 0.17 |
| 1-7 | 664/— | 10 (−12) | 400 | 5973 | 0.36 | 0.17 |
| 1-8 | 671/— | 5 (−15) | 355 | 5171 | 0.39 | 0.16 |
| 1-9 | 676/— | 5 (−15) | 395 | 5318 | 0.37 | 0.17 |
| 1-10 | 660/450 | 20 (−7) | — | 4544 | 0.38 | — |
| 1-11 | 660/500 | 20 (−7) | — | 5216 | 0.39 | — |
| 1-12 | 660/550 | 20 (−7) | — | 5794 | 0.35 | — |
| 1-13 | 660/600 | 20 (−7) | — | 6050 | 0.29 | — |
| 1-14 | 660/600 | 20 (−7) | — | 4544 | 0.22 | — |

A comparison run with solvent dewaxing (MEK/toluene) to 5° F. (−15° C.) pour point yielded a product with an RBOT of 495 minutes, TOST of 6428 hours, and sulfur content of 0.35 (total) and 0.17 (aliphatic) weight percent, respectively.

these results show that the absence of the metal function on the dewaxing catalyst results in no significant increase in desulfurization as the catalyst ages and the temperature is increased. The products all possessed excellent oxidation stability and were suitable for use as turbine oils.

Example 2

The same light neutral oil was subjected to dewaxing over a NiZSM-5 dewaxing catalyst (65 wt. pct. ZSM-5, 35 wt. pct. alumina, 1 wt. pct. Ni on catalyst) under similar conditions at 1 LHSV, 400 psig $H_2$ (2860 kPa abs.), 2500 SCF/Bbl $H_2$:oil (445 n.l.l.$^{-1}$), followed by hydrotreating of the dewaxed product as described above. The topped (650° F., 345° C.+) product was then tested for RBOT and TOST. The results are given in Table 3 below.

TABLE 3

| Properties of Light Neutral Turbine Oil Dewaxed Over Ni ZSM-5 | | | | | | | |
|---|---|---|---|---|---|---|---|
| Run | Hydrodewaxing Temperature, °F. (°C.) | Hydrofinishing Temperature, °F. (°C.) | Pour Point °F. (°C.) | Oxidation Stability RBOT - minutes | Sulfur, wt pct | Aliphatic Sulfur, | TOST hrs |
| 1-11 | 572 (300) | 500 (260) | 30 (−1) | 465 | 0.18 | 0.10 | 5378 |
| 1-12 | 575 (302) | 500 (260) | 15 (−9) | 485 | 0.18 | 0.10 | 4887 |
| 1-13 | 585 (307) | 500 (260) | 35 (2) | 500 | 0.18 | 0.10 | 5062 |
| 1-14 | 639 (337) | 500 (260) | 35 (2) | 380 | 0.17 | 0.09 | 3866 |
| 1-15 | 664 (351) | 500 (260) | 15 (−9) | 295 | 0.12 | 0.04 | 2225 |
| 1-16 | 671 (355) | 500 (260) | 20 (−7) | 295 | 0.115 | 0.04 | — |
| 1-17 | 676 (358) | 500 (260) | 15 (−9) | 260 | 0.17 | 0.05 | 1352 |
| 1-18 | 584 (307) | 400 (204) | 5 (−15) | 485 | 0.315 | 0.14 | 4635 |
| 1-19 | 594 (312) | 400 (204) | 15 (−9) | 470 | 0.305 | 0.14 | — |
| 1-20 | 608 (320) | 400 (204) | 15 (−9) | 480 | 0.295 | 0.13 | 4337 |
| 1-21 | 634 (334) | 400 (204) | 5 (−15) | 440 | 0.32 | 0.12 | — |
| 1-22 | 645 (340) | 400 (204) | 5 (−15) | 410 | 0.30 | 0.10 | 2526 |
| 1-23 | 652 (344) | 400 (204) | 20 (−7) | 360 | 0.28 | 0.08 | — |

TABLE 3-continued

| Run | Hydrodewaxing Temperature, °F. (°C.) | Hydrofinishing Temperature, °F. (°C.) | Pour Point °F. (°C.) | Oxidation Stability RBOT - minutes | Sulfur, wt pct | Aliphatic Sulfur, | TOST hrs |
|---|---|---|---|---|---|---|---|
| | Properties of Light Neutral Turbine Oil Dewaxed Over Ni ZSM-5 | | | | | | |
| 1-24 | 672 (355) | 400 (204) | 15 (−9) | 295 | 0.23 | 0.06 | 1517 |

Comparison of Tables 2 and 3 above shows that the catalyst without a metal function is capable of producing turbine oil with a minimum TOST of about 4000 hours at temperatures as high as about 676° F. (358° C.) whereas the nickel-containing dewaxing catalyst is frequently ineffective at temperatures above about 630° F. (about 330° C.).

Example 3

The waxy raffinate of Example 1 was subjected to dewaxing over an HZSM-5 dewaxing catalyst (65 wt. HZSM-5, 35 wt. pct. alumina) at 660° F. (349° C.), 400 psig $H_2$ (2860 kPa abs.) at 2 LHSV. The dewaxed product was then hydrotreated at temperatures from 450° to 600° F. (232°-315° C.) at 1 or 2 LHSV over a molybdenum /alumina hydrotreating catalyst. The results are given in Table 4 below. TOST results were obtained with the same standard additive package described above.

TABLE 4

| Run | Hydrodewaxing Temperature, °F. (°C.) | Hydrofinishing Temperature, °F. (°C.) | Pour Point °F. (°C.) | RBOT, Minutes | Sulfur, wt pct | TOST Hrs | HDF LHSV $hr^{-1}$ |
|---|---|---|---|---|---|---|---|
| | HZSM-5 Lube Dewaxing | | | | | | |
| 3-1 | 660 | 450 | 20 | 525 | 0.38 | 6613 | 2 |
| 3-2 | 660 | 500 | 20 | 525 | 0.39 | 5216 | 2 |
| 3-3 | 660 | 550 | 20 | 540 | 0.35 | 5794 | 2 |
| 3-4 | 660 | 600 | 20 | 520 | 0.29 | 6050 | 2 |
| 3-5 | 660 | 600 | 20 | 465 | 0.22 | 4544 | 1 |

Example 4

The increased sulfur retention resulting from the use of the decationized zeolites was demonstrated by dewaxing a light neutral raffinate turbine oil stock over NiZSM-5 (1 wt. pct. Ni) and HZSM-5 dewaxing catalysts (35% ZSM-5, 65% $Al_2O_3$), at 650° F. (343° C.), 1 $hr^{-1}$ LHSV and 400 psig (2860 kPa abs).

The properties of the products are given in Table 5 below, together with a comparison with a solvent dewaxed oil.

TABLE 5

| HDT Temp, °F. | ASTM Color | $Br_2$ No. | LN Sulfur Retention Pour Pt. °F. | Pour Pt. °F. | $N_{total}$ ppm | $N_{basic}$ ppm | $S_{total}$ % | $S_{aliph}$ % |
|---|---|---|---|---|---|---|---|---|
| Ni-ZSM-5 HDW Products | | | | | | | | |
| None* | L.15 | 2.35 | 15 | 30 | 21 | 21 | 0.60 | 0.24 |
| 350 | L1.0 | 3.14 | 15 | 26 | 17 | 22 | 0.58 | 0.23 |
| 400 | L.05 | 3.08 | 20 | 23 | 18 | 21 | 0.58 | 0.22 |
| 450 | L0.5 | 2.78 | 10 | 21 | 17 | 22 | 0.58 | 0.23 |
| 500 | 0.5 | 2.28 | 5 | 18 | 19 | 21 | 0.58 | 0.22 |
| SDWO | — | — | — | — | 19 | 19 | 0.62 | 0.25 |
| HDZSM-5 HDW Products | | | | | | | | |
| None* | L1.5 | 1.62 | 20 | 32 | 21 | 23 | 0.64 | 0.28 |
| 350 | L1.0 | 2.21 | 15 | 26 | 16 | 22 | 0.62 | 0.28 |
| 400 | L1.0 | 2.26 | 15 | 23 | 19 | 22 | 0.62 | 0.27 |
| 450 | L0.5 | 1.84 | 10 | 20 | 19 | 22 | 0.62 | 0.28 |
| 500 | L0.5 | 1.62 | 10 | 18 | 18 | 22 | 0.62 | 0.27 |

*Inter-reactor sample (HDW reactor only)

The improved process of this invention is demonstrated in a large scale hydrodewaxing unit employing partially cracked aromatic liquid petroleum chargestock containing paraffin wax. The process is carried out in a three-bed vertical reactor tower having interbed distribution as described in FIG. 1. The dewaxing is carried out by uniformly distributing and contacting the liquid chargestock at initial reaction temperature of about 295° C. to 300° C. in the presence of cofed hydrogen ( at partial hydrogen pressure of about 18,000 kPa (2600 psi) with an acid ZSM-5 aluminosilicate hydrodewaxing catalyst, substantially as described above. The catalyst is free of Ni or other hydrogenation- dehydrogenation components. The treatment proceeds by selectively hydrodewaxing in the top catalyst bed under adiabatic cracking temperature conditions while controlling adiabatic exothermal heat of reaction within a 30° C. maximum excursion from the initial reaction temperature, thereby producing lighter olefinic components; recovering and redistributing the partially hydrodewaxed liquid petroleum for contact with said catalyst in the second downstream fixed catalyst bed. This is followed in the second bed by further reacting the partially hydrocracked liquid petroleum and olefinic component to effect endothermic hydrodewaxing concurrently with exothermic hydrogen transfer, dewaxing, hydrogenation and cyclization in the presence of hydrogen under adiabatic temperature conditions, permitting net exothermic reaction temperature to rise not more than 30° C. in the second catalyst bed. At this point temperature control is maintained by injecting quench fluid (20% of total hydrogen cofed) into the third downstream catalyst bed concurrently with partially hydrodewaxed liquid petroleum to decrease reaction temperature, thereby maintaining a maximum temperature excursion of about 30° C. throughout said series of fixed catalyst beds and controlling uniform hydro-dewaxing conditions to obtain high quality petroleum lubricant product.

Figure 2:
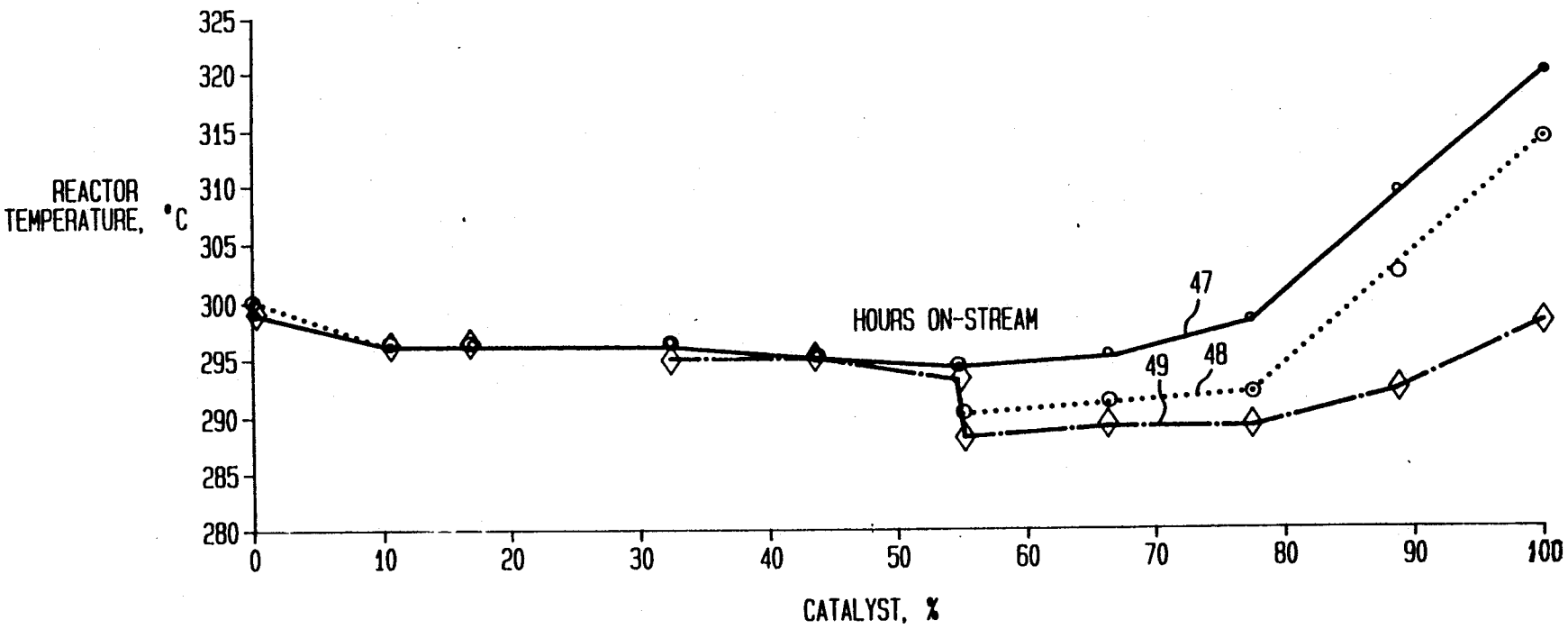
FIG. 2 is a reactor temperature profile plot.

Referring to FIG. 2, a series of graphic plots are shown for the reactor temperature profile. These profiles are taken after the reactor has reached steady state condition following 47 hours on stream in continuous use. Line 47 shows the temperature across the entire multi-zone catalyst bed, with substantial temperature increase in the last bed portion. Line 48 shows the temperature profile of the same reactor and feed one hour later, which 20% hydrogen injection quench, which lowers the reactant temperature about 5° C. between beds. Line 49 depicts another steady state run at 49 hours on stream, with hydrogen injected at ° C. to lower the reactant temperature about 8° C. at the top of the last bed. The quenched reactants show an overall temperature rise about 5° to 25° C. less than unquenched reactants.

While the invention has been explained by reference to preferred embodiments, there is no intent to limit the inventive concept, except as set forth in the following claims.

We claim:

1. A cyclic catalytic lubricant hydro-dewaxing process for treating high-boiling, paraffinic wax-containing liquid petroleum chargestock, said chargestock containing less than 60 wt % aromatics, comprising:

uniformly distributing and contacting the liquid chargestock in the presence of cofed hydrogen at a pressure of at least 7000 kPa and initial start-of-cycle contact temperature not greater than 315° C. with an acid shape-selective, medium poremetallosilicate hydro-dewaxing catalyst, said catalyst being substantially free of hydrogenation-dehydrogenation components in a reactor having a series of fixed downflow catalyst beds;

selectively hydrodewaxing paraffinic wax contained in the liquid petroleum in a first serial catalyst bed under adiabatic cracking temperature conditions to partially reduce wax content and thereby producing lighter olefinic components;

recovering partially dewaxed liquid petroleum and hydrogen-rich gas from a bottom portion of the first serial catalyst bed and redistributing substantially all of said partially hydrodewaxed liquid petroleum and hydrogen-rich gas for contact with said catalyst in at least one downstream fixed catalyst bed;

further reacting said partially dewaxed liquid petroleum and olefinic component to effect additional endothermic dewaxing, and exothermic hydrogen transfer, olefin oligomerization, hydrogenation and cyclization in the presence of hydrogen under adiabatic temperature conditions, permitting reaction temperature to rise not more than 30° C. in said downstream catalyst bed;

injecting hydrogen-rich quench gas at the inlet of at least one downstream catalyst bed concurrently with partially hydrodewaxed liquid petroleum to decrease reaction temperature, thereby maintaining a maximum temperature excursion of about 30° C. throughout said series of fixed catalyst beds and controlling uniform hydro-dewaxing conditions to obtain high quality petroleum lubricant product.

2. The process of claim 1 wherein said reactor comprises a vertical column containing at least three separate catalyst beds with uniform liquid distribution above each bed, and wherein cold hydrogen quench gas is injected into effluent from an exothermic middle bed.

3. The process of claim 1 wherein said liquid petroleum chargestock is high pressure hydrocracked gas oil containing about 1 to 40 wt % mononuclear aromatic hydrocarbons and boiling above about 315° C.

4. The process of claim 1 wherein said liquid petroleum chargestock consists essentially of distillate or bright stock.

5. The process of claim 1 wherein said catalyst comprises aluminosilicate zeolite having a constraint index of about 2 to 12 and an acid cracking alpha value less than 150.

6. The process of claim 5 wherein said catalyst consists essentially of aluminosilicate zeolite having the structure of ZSM-5 and an alpha value of about 45 to 95.

7. The process of claim 1 wherein hydrogen partial pressure in said first serial catalyst bed is at least 18,000 kPa, and wherein hydrodewaxing is conducted without substantial net consumption of hydrogen.

8. The process of claim 7 wherein said liquid petroleum chargestock comprises hydrocracked gas oil containing about 1 to 40 wt % mononuclear aromatic hydrocarbons and boiling above about 315° C.

9. The process of claim 8 wherein said liquid petroleum chargestock consists essentially of distillate or bright stock; and wherein said catalyst comprises aluminosilicate zeolite having a constraint index of about 2 to 12 and an acid cracking alpha value less than 150.

10. The process of claim 7 including the step of separating hydrodewaxed reactor effluent to recover a 315° C.+boiling range lubricant product having kinematic viscosity in the range of 10 to 160 cSt. at 40° C.

11. A cyclic process for making a lubricant oil of low pour point and improved oxidation stability which comprises:

(a) catalytically hydro-dewaxing a lubricant range aromatic liquid petroleum chargestock containing paraffin wax in the presence of hydrogen over a dewaxing catalyst comprising medium pore size zeolite in the hydrogen or decationised form during a dewaxing cycle in which the temperature is progressively increased to maintain a substantially constant product pour point to produce a lubricant oil product of improved oxidation stability, the cumulative aging rate of the catalyst being less than 5° F. per day;

(d) uniformly distributing and contacting the liquid chargestock at initial start-of-cycle reaction temperature of about 200° C. to 315° C. in the presence of cofed hydrogen at partial hydrogen pressure of about 7000 to 20,000 kPa with an acid, shape-selective, medium pore metallosilicate hydro-dewaxing catalyst, said catalyst being substantially free of hydrogenation- dehydrogenation components in a vertical column reactor having a series of fixed downflow catalyst beds;

(c) selectively hydrodewaxing paraffinic wax contained in the liquid petroleum in a first serial catalyst bed under adiabatic cracking temperature conditions while controlling adiabatic exothermal heat of reaction with a 30° C. maximum excursion from the initial reaction temperature, thereby producing lighter olefinic components;

(d) recovering partially hydrodewaxed liquid petroleum from a bottom portion of the first serial catalyst bed and redistributing substantially all of said partially hydrodewaxed liquid petroleum for contact with said catalyst in at least one downstream fixed catalyst bed;

(e) further reacting said partially hydrodewaxed liquid petroleum and olefinic component to effect endothermic hydrodewaxing concurrently with exothermic hydrogen transfer, dewaxing, hydrogenation and cyclization in the presence of hydrogen under adiabatic temperature conditions, permitting net exothermic reaction temperature to rise not more than 30° in said downstream catalyst bed;

(f) injecting quench fluid into at least one downstream catalyst bed concurrently with partially hydrodewaxed liquid petroleum to decrease reaction temperature, thereby maintaining a maximum temperature excursion of about 30° C. throughout said series of fixed catalyst beds and controlling uniform hydro-dewaxing conditions to obtain high quality petroleum lubricant product; and (f) regenerating the catalyst when an end-of-cycle maximum catalyst bed temperature of 375° C. is reached.

12. A process according to claim 11 wherein the dewaxing cycle is carried out a temperature not greater than about 315° C.; and where the intermediate pore size zeolite comprises aluminosilicate ZSM-5.

13. In the process for making a lubricant oil of low pour point by catalytically dewaxing a wax-containing lubricant boiling range liquid petroleum charge stock in the presence of hydrogen over a hydrodewaxing catalyst containing acid intermediate pore size zeolite in the hydrogen or decationized form, during a dewaxing cycle at controlled temperature to produce a lubricant oil product of improved oxidation stability, the improvement which comprises:

uniformly distributing and contacting the liquid petroleum chargestock sequentially with cofed hydrogen and byproducts in a cascade multizone reactor having a series of fixed downflow catalyst beds containing the hydro-dewaxing catalyst, said catalyst being substantially free of nickel and other hydrogenation- dehydrogenation components;

selectively hydrodewaxing paraffinic wax contained in the liquid petroleum in a first serial catalyst bed in the presence of cofed hydrogen under a diabetic cracking temperature conditions, having an initial contact temperature not greater than 315° C., to partially reduce wax content and thereby producing lighter olefinic components;

recovering partially dewaxed liquid petroleum and hydrogen-rich gas from a bottom portion of the first serial catalyst bed and redistributing said partially hydrodewaxed liquid petroleum, lighter olefinic components and hydrogen-rich gas for contact with said catalyst in at least one downstream fixed catalyst bed;

further reacting said partially dewaxed liquid petroleum and olefinic component to effect additional endothermic dewaxing, and exothermic hydrogen transfer, olefin oligomerization, hydrogenation and cyclization in the presence of hydrogen under adiabatic temperature conditions, permitting reaction temperature to rise not more than 30° C. in said downstream catalyst bed;

injecting hydrogen-rich quench gas at the inlet of at least one downstream catalyst bed concurrently with partially hydrodewaxed liquid petroleum, lighter olefinic components and hydrogen-rich gas to decrease reaction temperature, thereby maintaining a maximum temperature excursion of about 30° C. throughout said series of fixed catalyst beds and controlling uniform hydro-dewaxing conditions to obtain high quality petroleum lubricant product; whereby duration of a dewaxing cycle is longer than that of a dewaxing cycle under comparable conditions using a nickel-containing dewaxing catalyst.

14. A cyclic catalytic lubricant hydro-dewaxing process for treating high-boiling, paraffinic wax-containing liquid petroleum chargestock during a dewaxing cycle in which the temperature is progressively increased during successive cycles to maintain a substantially constant product pour point to produce a lubricant oil product of improved oxidation stability, the cumulative aging rate of the catalyst being less than 5° F. per day; said chargestock containing high pressure hydrocracked gas oil containing about 1 to 40 wt % mononuclear aromatic hydrocarbons and boiling above about 315° C., comprising:

uniformly distributing and contacting the liquid chargestock in the presence of cofed hydrogen at a pressure of at least 7000 kPa with an acid, shape-selective, medium pre metallosilicate hydrodewaxing catalyst, said catalyst being substantially free of hydrogenation-dehydrogenation components in a reactor having a cascade series of fixed downflow catalyst beds;

selectively hydrodewaxing paraffinic wax contained in the liquid petroleum in a first serial catalyst bed under adiabatic cracking temperature conditions and initial start-of-cycle contact temperature not greater than 315° C. to partially reduce wax content and thereby producing lighter olefinic components, wherein hydrogen partial pressure in said first serial catalyst bed is at least 18,000 kPa, and wherein hydrodewaxing is conducted without substantial net consumption of hydrogen, thereby minimizing reactions other than hydrocracking of paraffinic wax;

recovering partially dewaxed liquid petroleum and hydrogen-rich gas from a bottom portion f the first serial catalyst bed and redistributing said partially hydrodewaxed liquid petroleum and hydrogen-rich gas for contact with said catalyst in at least one downstream fixed catalyst bed;

further reacting said partially dewaxed liquid petroleum and olefinic component to effect additional endothermic dewaxing, and exothermic hydrogen transfer, olefin oligomerization, hydrogenation and cyclization in the presence of hydrogen under adiabatic temperature conditions, permitting reaction temperature to rise not more than 30° C. in said downstream catalyst bed;

injecting hydrogen-rich quench gas at the inlet of at least one downstream catalyst bed concurrently with partially hydrodewaxed liquid petroleum to decrease reaction temperature, thereby maintaining a maximum temperature excursion of about 30° C. throughout said series of fixed catalyst beds and controlling uniform hydro-dewaxing conditions to obtain high quality petroleum lubricant product;

separating hydrodewaxed reactor effluent to recover a 315° C.+ boiling range lubricant product having kinematic viscosity in the range of 10 to 160 cSt at 40° C.; and regenerating the catalyst when an end-of-cycle maximum catalyst bed temperature of 375° C. is reached.

15. The process of claim 14 wherein catalyst is regenerated with hot hydrogen.

* * * * *

UNITED STATES PATENT AND TRADEMARK OFFICE

CERTIFICATE OF CORRECTION

PATENT NO. : 5,246,568

DATED : September 21, 1993

INVENTOR(S) : Forbus et al.

It is certified that error appears in the above-identified patent and that said Letters Patent is hereby corrected as shown below:

Col. 17, lines 31-32, "poremetallosilicate" should be --pore metallosilicate--.
Col. 20, line 21, delete "pre" and replace with --pore--.
Col. 20, line 38, "f the" should read --of the--.

Signed and Sealed this

Fifteenth Day of March, 1994

*Attest:*

*Attesting Officer*

Bruce Lehman

BRUCE LEHMAN

*Commissioner of Patents and Trademarks*